United States Patent [19]

Beronia

[11] 4,128,181

[45] Dec. 5, 1978

[54] APPARATUS FOR LOADING AND COMPRESSING SOLID WASTE IN A BOX-LIKE STRUCTURE

[75] Inventor: Mario Beronia, Rome, Italy

[73] Assignee: BAT Brevets et Applications Techniques S.A., Montreux, Switzerland

[21] Appl. No.: 798,453

[22] Filed: May 19, 1977

[30] Foreign Application Priority Data

May 28, 1976 [CH] Switzerland ..... 6691/76

[51] Int. Cl.[2] ..... B65F 3/00

[52] U.S. Cl. ..... 214/83.3

[58] Field of Search ..... 214/83.3; 100/233

[56] References Cited

U.S. PATENT DOCUMENTS

| | | | |
|---|---|---|---|
| 2,371,540 | 3/1945 | Mott | 214/83.3 |
| 2,703,184 | 3/1955 | Barrett | 214/83.3 X |
| 3,572,526 | 3/1971 | Gollnick | 214/83.3 |

*Primary Examiner*—Albert J. Makay
*Assistant Examiner*—Donald W. Underwood
*Attorney, Agent, or Firm*—Weingarten, Maxham & Schurgin

[57] ABSTRACT

An apparatus for loading and compressing solid waste in a box-like container mounted on a road vehicle for the collection and the transportation of waste. The apparatus is equipped with a lifting shovel hinged at one of its ends onto the solid structure that carries the box and further with a compressing shovel, also hinged onto the container and on a shaft common to both the lifting and compressing shovels.

2 Claims, 6 Drawing Figures

APPARATUS FOR LOADING AND COMPRESSING SOLID WASTE IN A BOX-LIKE STRUCTURE

FIELD OF THE INVENTION

This invention relates generally to waste transportation apparatus and more particularly concerns a novel structure for transferring the waste from a loading inlet to the interior of a box-like container.

DISCUSSION OF THE PRIOR ART

Known designs of this type comprise a structure or container on a road vehicle carrying a square box of substantial size that on its front part is equipped with a push plate or shovel controlled in its movement by a telescopic cylinder of single effect. Such plate has the task of shoving the waste out of the box during the unloading phase. The rear part of the box is closed by a door hinged at its upper side onto the box itself and will be opened by hydraulic hoists or jacks in order to facilitate the unloading phase of the waste. At the interior of the door is disposed the mechanism for loading and compressing the waste into the box. This mechanism is formed by two pairs of cylinders that alternate during the two operating phases to control the two steps of loading and compressing the waste. This system has the disadvantages of occasionally providing phase shifting in the working cycles, and an elevated noise level due to the starting and stopping of the cylinders themselves.

SUMMARY OF THE INVENTION

It is an object of this invention to carry out the loading and compressing steps of the waste in a continuous cycle without intermittent phases and thus without the possibility of phase shifting of the cycles all at maximum quietness of operation.

According to the invention, the apparatus has two shovels pivotally connected to the container at their ends and mutually connected to a supporting rod extending between two connecting points on the periphery of a shaft rotated by a drive, the connecting points lying in different planes which are at right angles to the longitudinal axis of the rotating shaft.

BRIEF DESCRIPTION OF THE DRAWING

The objects, advantages and features of the invention will be readily apparent from the following detailed description when read in conjunction with the accompanying drawing in which.

FIG. *2a* shows the mechanism of the invention in the initial position for loading the waste into the mechanism;

FIG. *2b* shows the mechanism of FIG. 2 in an intermediate position for lifting the waste to the inlet of the box;

FIG. *2c* shows the mechanism of FIG. 2 at the beginning of the waste compression operation; and FIG. *2d* shows the mechanism of FIG. 2 at the end of the waste compression operation.

Figure 3:
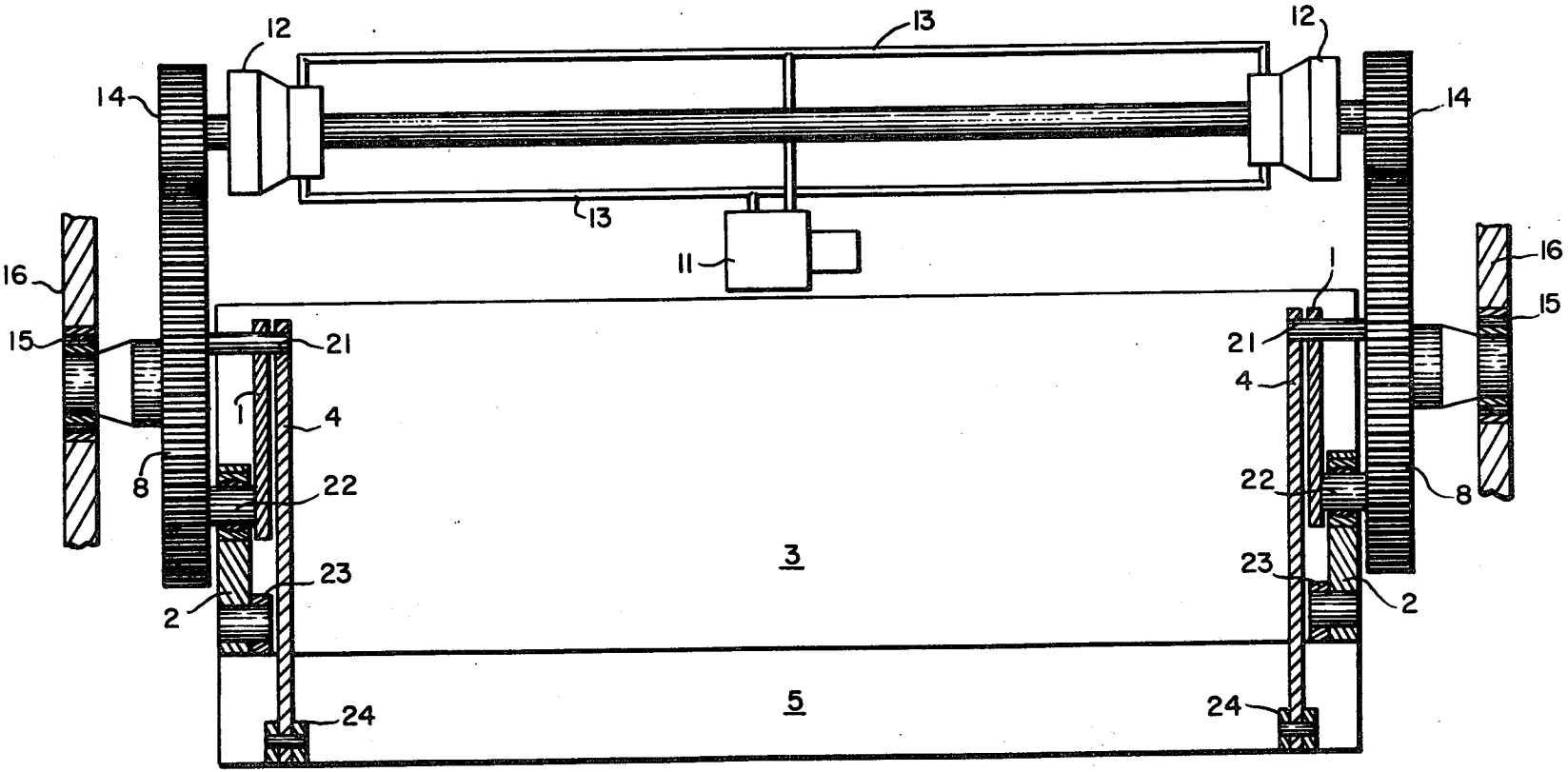

FIG. 3 is a top schematic view of the apparatus of the invention.

DETAILED DESCRIPTION OF THE PREFERRED EMBODIMENT

Figure 1:
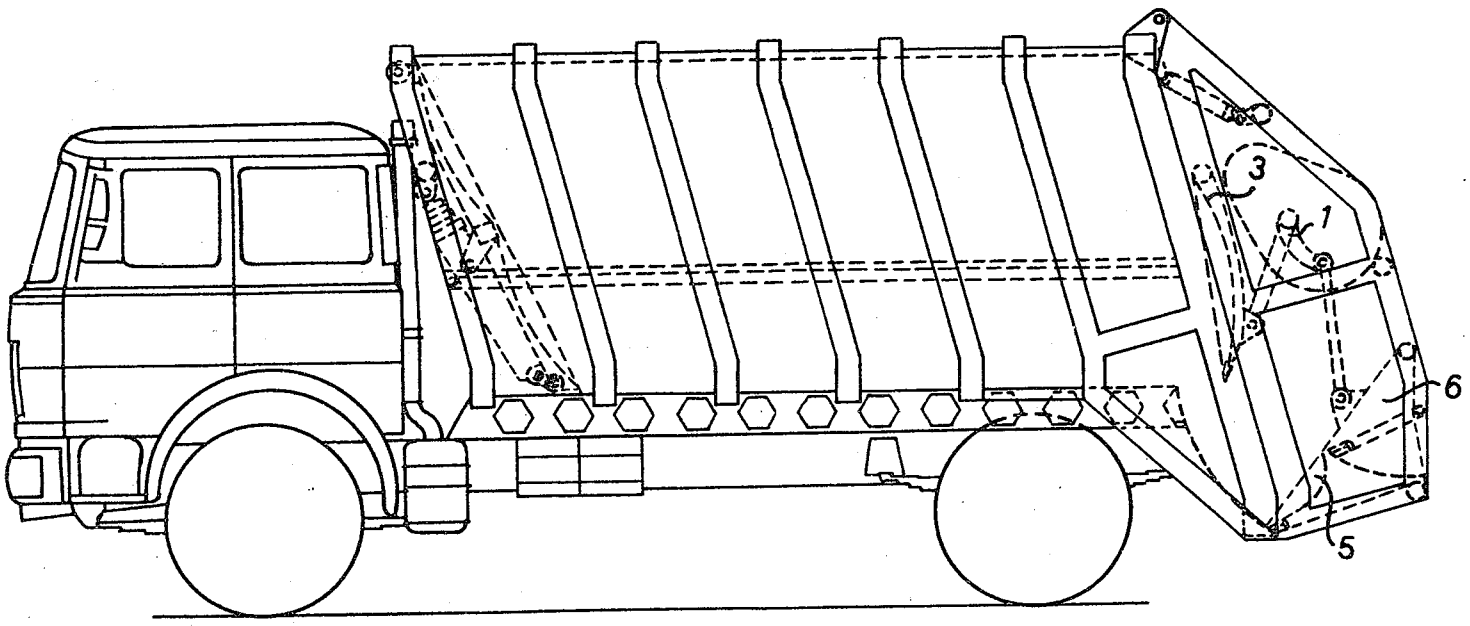
FIG. 1 is a side view of the road vehicle including the apparatus of the invention.

With reference now to the drawing and more particularly to FIG. 1 thereof, there is shown a conventional waste transport truck comprised of a chassis with a box-like container mounted thereon. The loading and compressing mechanism at the rear of the container is shown in phantom lines since it is hidden from view in this figure.

The structure and operation of the mechanism of this invention is clearly shown in FIGS. *2a–2d*. The waste material is inserted in loading inlet 6. When sufficient waste has been placed in inlet 6 so that shovel 5 is filled, the mechanism commences the loading and compression operation upon actuation of a conventional motor-reducer group, preferably a hydrostatic drive. A variable output pump 11 feeds hydrodynamic motors 12 through pipes 13 for synchronous rotation of pinions 14 on either side of the apparatus. These pinions engage disk-like shaft means 8 which are journaled in container walls 16 by means of bearings 15. Supporting link 1 is mounted to shaft means 8 for rotation therewith by connections 21 and 22. Rod 2 is shown pivotably mounted to connection 22 between shaft means 8 and link 1 and is pivotably connected to compression shovel 3 at mounting 23. Rod 4 is pivotably coupled between mounting 21 and lifting shovel 5 by means of pivotable mount 24. The motor-reducer group provides continuous rotary motion through shaft means 8 to supporting link 1 which is mounted along the periphery of the shaft. Rod 2 is pivotally connected to link 1 at one end and to compression shovel 3 at the other. The other end of the compression shovel is pivotally connected to the container. Another rod 4 is pivotally connected at one end to link 1 at a position spaced from the connection to rod 2, and at the other end to lifting shovel 5. At a point spaced from the connection to rod 4, lifting shovel 5 is pivotally connected to the container. The connecting point of rod 2 to link 1 lies in a plane spaced at right angles to the longitudinal axis of shaft means 8 with respect to the plane of the connecting point of rod 4 to link 1.

Figure 2A:
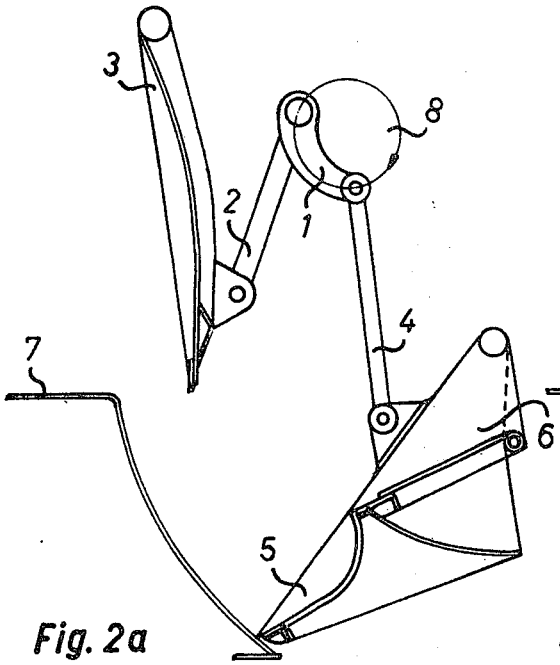
Figure 2B:
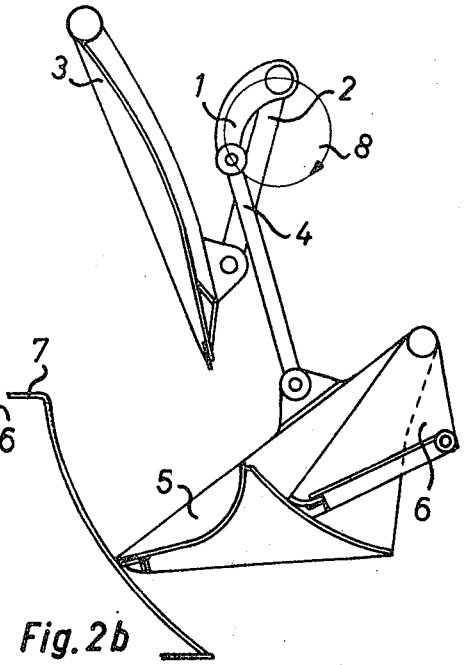
Figure 2C:
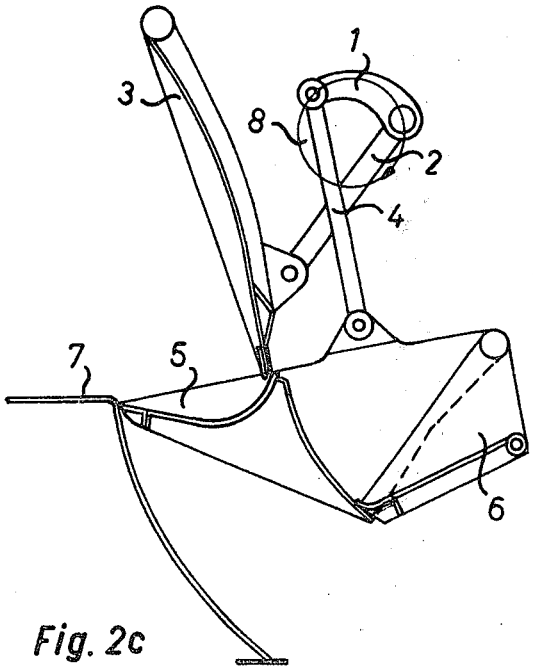
Figure 2D:
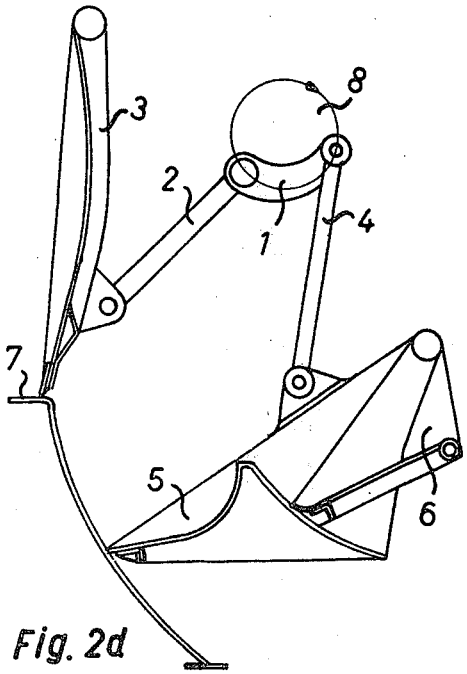

When the loading inlet is filled, rotation of shaft means 8 causes the inner end of shovel 5 to lift toward inlet 7 of the container as shown in FIGS. 2i a–2*c*. While shovel 5 is rising, the lower end of compression shovel 3 move rearwardly. The compression shovel moves the waste from shovel 5 into the container as shown in FIGS. *2c* and *2d*. At the end of the compression cycle, shovel 5 is returning to its initial position to receive more waste material.

During continuous operation, shaft 8 rotates and the operations of the shovels in loading and compressing take place in synchronism without any possibility of phase shifting during a cycle. Additionally the operation of the mechanism is relatively quiet, there being no reciprocating cylinder involved.

In view of the above description, it is likely that modifications and improvements will occur to those skilled in this art which are within the scope of this invention.

What is claimed is:

1. Apparatus for loading and compressing solid waste in a box-like container mounted on a road vehicle for the collection and transportation of the waste, said container having spaced oppositely facing side walls and a rearward facing opening, said apparatus comprising:

a stationary inlet mounted in said opening in said container, said inlet having an inner end;

shaft means rotatably mounted on each side wall of said container;

means for rotating said shaft means;

supporting link means mounted to said shaft means for rotation therewith, said link extending between two peripheral points on said shaft means;

a lifting shovel disposed between and pivotably connected at one end to each side wall of said container, the bottom of said shovel comprising two concave sections meeting at a point approximately midway between said one end and the free end of said shovel, said first concave section being adjacent said one end of said shovel and said inner end of said stationary inlet being closely adjacent said first concave section during operation of said apparatus;

a compression shovel disposed between and pivotably connected at one end to said container side walls, the free end thereof extending toward said lifting shovel;

first rod means having one end pivotably connected to one end of said supporting link at one of said peripheral points, the other end of said first rod being pivotably connected to said compression shovel at a location spaced from said one end thereof; and second rod means having one end pivotably connected to the other end of said supporting link at the other of said peripheral points, the other end of said second rod being pivotably connected to said lifting shovel at a point spaced from said one end thereof;

whereby when said shaft means is rotated, said first and second rods and said lifting and compression shovels are caused to move in an oscillatory manner, said first concave section of said lifting shovel being curved in such a manner as to slide beneath and closely adjacent said inner end of said stationary inlet, said second concave section moving alternatingly toward and away from said opening in said container, said first and second rods being dimensioned and connected to said compression and lifting shovels in such a manner that said free end of said compression shovel substantially sweeps along said second concave section of said lifting shovel when said free end of said lifting shovel moves to the vicinity of said opening in said container.

2. The apparatus recited in claim 1 wherein:

said shaft means comprises a disk-like shaft member rotatably mounted to each said side wall of said container;

said supporting link means comprises a link fixed to the inner face of each said shaft member;

said first rod means comprises a rod coupled between said one end of each said supporting link and to each adjacent opposite side of said compression shovel; and said second rod means comprises a rod coupled between said other end of said supporting link and to each adjacent opposite side of said lifting shovel.

* * * * *